US012134947B1

(12) United States Patent
Eiman et al.

(10) Patent No.: US 12,134,947 B1
(45) Date of Patent: Nov. 5, 2024

(54) WET MATE CARRIER FOR RADIAL DEPLOYMENT OF DOWNHOLE WET MATE CONNECTOR

(71) Applicant: Halliburton Energy Services, Inc., Houston, TX (US)

(72) Inventors: Tyson H. Eiman, Frisco, TX (US); Ben C. McGregor, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/375,594

(22) Filed: Oct. 2, 2023

(51) Int. Cl.
*E21B 17/02* (2006.01)
*E21B 33/038* (2006.01)

(52) U.S. Cl.
CPC ..... *E21B 33/0385* (2013.01); *E21B 17/028* (2013.01)

(58) Field of Classification Search
CPC ..... E21B 17/028; E21B 33/0385
See application file for complete search history.

(56) References Cited

U.S. PATENT DOCUMENTS 7,165,892 B2 1/2007 Grigsby et al.
7,556,093 B2 7/2009 Grigsby et al.
7,594,763 B2 * 9/2009 Richards ..... E21B 17/028 166/385
7,900,698 B2 3/2011 Stoesz
11,105,160 B2 * 8/2021 Leismer ..... H01R 13/5219
2008/0311776 A1 12/2008 Cox et al.
2013/0153203 A1 6/2013 Lauderdale
2014/0318809 A1 10/2014 Joensen et al.
2016/0290108 A1 10/2016 Preston et al.
2022/0178212 A1 * 6/2022 Wetzel ..... E21B 17/028

FOREIGN PATENT DOCUMENTS

KR 20220148362 A 11/2022
WO 2022109157 A1 5/2022

OTHER PUBLICATIONS

TE Connectivity , "Low Loss Optical Performance, Optical Wet-Mate Connector", 2 pages, 2019.
International Patent Application No. PCT/US2023/034256, International Search Report and Written Opinion mailed Jun. 25, 2024, 10 pages.

* cited by examiner

*Primary Examiner* — Matthew R Buck
(74) *Attorney, Agent, or Firm* — Kilpatrick Townsend & Stockton LLP

(57) ABSTRACT

A system can be used to deploy a wet mate connector radially outward. The system can include a first sub-assembly and a second sub-assembly. The first sub-assembly can include a first wet mate connector and a deflection profile. The second sub-assembly can include (i) a wet mate carrier that can include a second wet mate connector and can be located on a second surface of the second sub-assembly, and (ii) a deflection actuator. The deflection actuator can be displaced by the deflection profile to cause the wet mate carrier to deflect outward to cause the second wet mate connector to couple with the first wet mate connector.

20 Claims, 7 Drawing Sheets

WET MATE CARRIER FOR RADIAL DEPLOYMENT OF DOWNHOLE WET MATE CONNECTOR

TECHNICAL FIELD

The present disclosure relates generally to wellbore operations and, more particularly (although not necessarily exclusively), to a wet mate carrier for radial deployment of a downhole wet mate connector.

BACKGROUND

Wellbore operations may include various equipment, components, methods, or techniques to form a wellbore, to displace and release produced material, such as hydrocarbons, water, and the like, using a wellbore or flowline, and the like. The wellbore may include one or more obstructions such as a radial obstruction that may limit a radius of tools or material allowed to flow through the wellbore. Traversing the one or more obstructions while retaining an adequate bore radius can be technically challenging.

DETAILED DESCRIPTION

Figure 1:
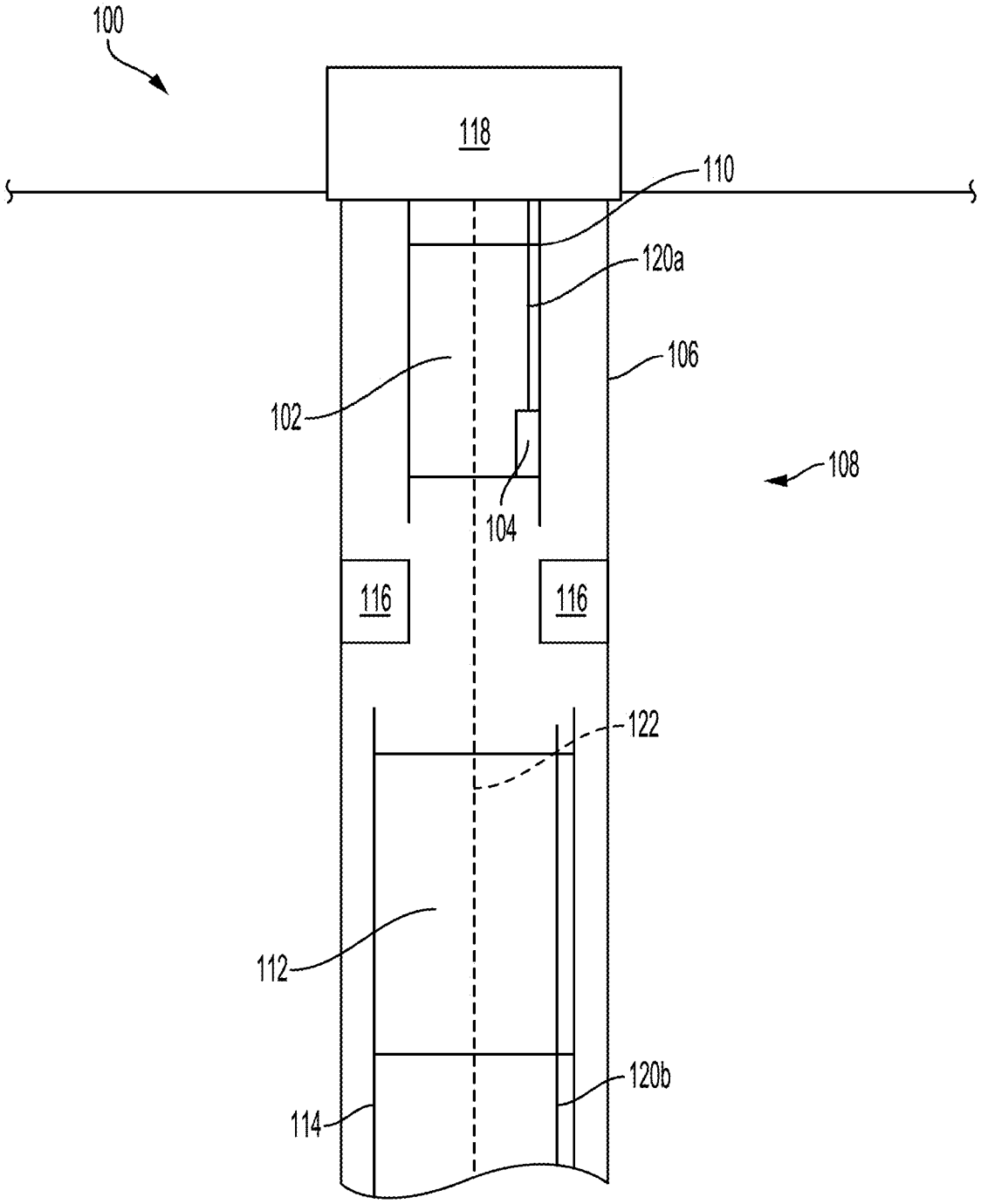
FIG. 1 is a block diagram of a well system that can include a sub-assembly having a wet mate carrier according to one example of the present disclosure.

Certain aspects and examples of the present disclosure relate to a wet mate carrier that can be positioned on a first sub-assembly and that can be deployed radially outward to couple a first wet mate connector with a second wet mate connector of a second sub-assembly. The first sub-assembly can be or include a stinger sub-assembly, a production sub-assembly, or other suitable sub-assemblies that can be positioned in a wellbore for performing one or more wellbore operations. The wet mate carrier may include the first wet mate connector and may be positioned on an outer surface or an external surface of the first sub-assembly. The second wet mate connector may be positioned on the second sub-assembly, which may be or include a completion sub-assembly or other suitable sub-assemblies that can be positioned in the wellbore for performing one or more wellbore operations. The first wet mate connector, the second wet mate connector, or a combination thereof, may be or include a connector that is coupled to an energy transfer line, such as a fiber optic line, an electrical line, a hydraulic line, and the like, and that may be sized to receive a separate wet mate connector to couple the energy transfer line with a separate energy transfer line. The wet mate carrier may be mechanically actuated radially outward to at least approximately align the first wet mate connector with the second wet mate connector.

A wellbore can be formed in a geological formation to perform one or more operations such as producing hydrocarbon material and the like. The wellbore can include one or more obstructions, whether natural or artificial, which may limit a maximum diameter of tools, or production fluid, that can be run through the wellbore. One or more sub-assemblies can be positioned in the wellbore to facilitate the one or more operations. For example, a completion sub-assembly can be installed in the wellbore, and a production sub-assembly can be run-in-hole to be connected to the completion sub-assembly. Connecting sub-assemblies downhole may involve coupling energy transfer lines, such as fiber optic lines, electrical lines, hydraulic lines, and the like, to support the one or more operations. Passing the obstructions, for example with a first sub-assembly (e.g., the production sub-assembly), while maximizing a usable inner diameter in the first sub-assembly, a second sub-assembly (e.g., the completion sub-assembly), or a combination thereof may be difficult. The inner diameter may be used as a production flow area, an area through which tools may be passed, and the like.

A first sub-assembly, such as a production string sub-assembly, may include a first wet mate connector such as a female wet mate connector. A second sub-assembly, such as a completion string sub-assembly, may include a second wet mate connector such as a male wet mate connector. The first wet mate connector may be coupled with a first energy transfer line, and the second wet mate connector may be coupled with a second energy transfer line, which may be the same as or different from the first energy transfer line. The first wet mate connector may be positioned on a wet mate carrier, which may be positioned on an outer surface, an external surface, or the like of the first sub-assembly. The wet mate carrier may be in a retracted state while being run-in-hole into the wellbore. In response to, or substantially contemporaneous with respect to, the first sub-assembly being coupled with the second sub-assembly, the wet mate carrier may be actuated radially outward to cause the first wet mate connector to align with the second wet mate connector. In some examples, a first shoulder, such as a deflection actuator, may be positioned on the first sub-assembly and may engage with a second shoulder, such as a deflection profile, positioned on the second sub-assembly to cause the wet mate carrier to actuate radially outward. Subsequent to actuating the wet mate carrier radially outward into an actuated state, the first wet mate connector can be coupled with the second wet mate connector.

Running the wet mate carrier in the wellbore in the retracted state may allow the first sub-assembly to traverse obstructions, restrictions, and the like in the wellbore while optimizing an inner diameter of the first sub-assembly through which tools, production fluid, and the like can pass. For example, the first sub-assembly can pass through a gravel pack restriction then can transform the wet mate carrier into the actuated state to couple the first wet mate connector with the second wet mate connector.

The first sub-assembly may include the first wet mate connector, a housing, the deflection actuator, the wet mate carrier, and a set of springs. The set of springs may include a connector spring and one or more actuation springs. The connector spring may be coupled with the first wet mate connector and may facilitate coupling between the first wet mate connector and the second wet mate connector. The actuator spring may be coupled with the deflection actuator and may apply spring force on the deflection actuator to cause the wet mate carrier to return to a retracted state in response to disconnecting the first sub-assembly from the second sub-assembly. The second sub-assembly may include the second wet mate connector and may be mounted on a completion string, or any other suitable string, positioned in the wellbore. The wet mate carrier may allow multiple attempts to couple the first wet mate connector with the second wet mate carrier without risking damage to the first sub-assembly or the second sub-assembly, or any components thereof.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a block diagram of a well system 100 that can include a sub-assembly 102 having a wet mate carrier 104 according to one example of the present disclosure. The well system 100 can include a wellbore 106 that can be formed or otherwise positioned in a geological formation 108, such as a subterranean formation, a suboceanic formation, and the like. The sub-assembly 102 may be positioned on a first string 110, which may be or include a production string, and the sub-assembly 102 may be or include a stinger sub-assembly that may correspond to a bottom sub-assembly. The bottom sub-assembly may be or include a second sub-assembly 112, which may be positioned in the wellbore 106. The second sub-assembly 112 may be positioned on a second string 114, which may be or include a completion string that can be installed in the wellbore 106, for example during a completion operation with respect to the wellbore 106.

In some examples, the wellbore 106 may have an obstruction 116. The obstruction 116 may be natural, artificial, or a combination thereof. For example, the obstruction 116 may be or include a result of a gravel pack operation, may be or include damage to the wellbore 106, and the like. The sub-assembly 102 can be positioned, for example using a positioning tool 118 (e.g., a winch, etc.), in the wellbore 106 and can traverse or otherwise pass through the obstruction 116. For example, the sub-assembly 102 may have an outer diameter that may be approximately the same or less than an inner diameter of the obstruction 116. The sub-assembly 102 may be positioned in the wellbore 106 to be coupled with the second sub-assembly 112. For example, the sub-assembly 102 may be coupled with the second sub-assembly 112 to couple a first energy transfer line 120*a* with a second energy transfer line 120*b*. The first energy transfer line 120*a*, the second energy transfer line 120*b*, or a combination thereof may be or include a fiber optic transfer line, an electrical transfer line, a hydraulic transfer line, a different type of energy transfer line, or any combination thereof.

In some examples, the wet mate carrier 104 may be in a retracted state while the sub-assembly 102 is run-in-hole into the wellbore 106. For example, a first radius, with respect to a central axis 122 of the wellbore 106, of the wet mate carrier 104 may be smaller than a second radius of an outer surface of the second sub-assembly 112. Additionally or alternatively, the central axis 122 may be shared by the sub-assembly 102, the second sub-assembly 112, the wellbore 106, or any combination thereof. In response to the sub-assembly 102 successfully traversing the obstruction 116, or in response to the sub-assembly 102 contacting the second sub-assembly 112, the wet mate carrier 104 may be actuated radially outward into an actuated state. In the actuated state, the wet mate carrier 104 can be positioned at the second radius such that a first wet mate connector included in the wet mate carrier 104 is at least approximately aligned with a second wet mate connector positioned on the second sub-assembly 112. The first wet mate connector and the second wet mate connector can be coupled together one or more times to facilitate one or more operations to be performed with respect to the wellbore 106.

Figure 2:
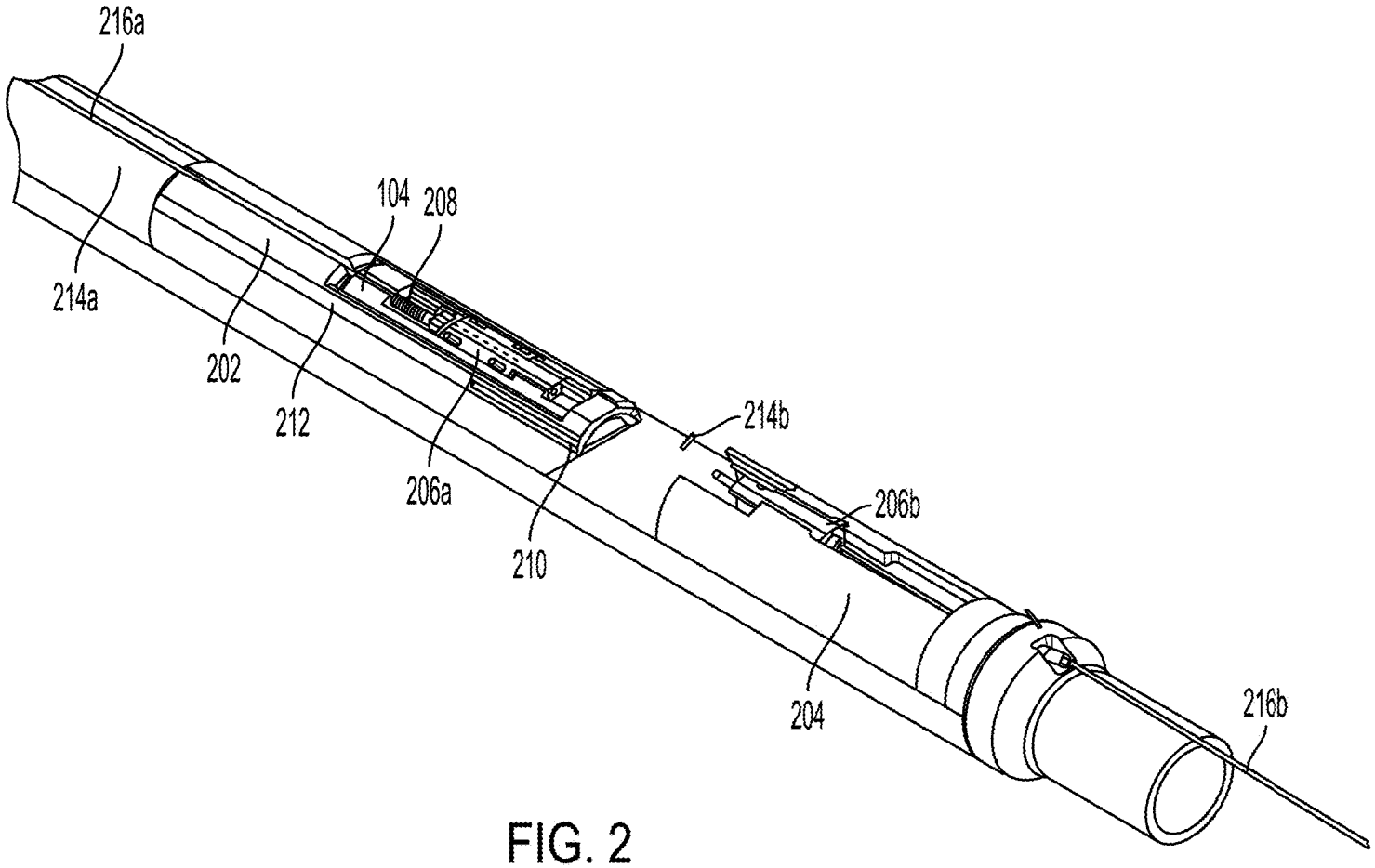
FIG. 2 is a perspective view of a first sub-assembly with a wet mate carrier and a second sub-assembly that can receive the first sub-assembly in a wellbore according to one example of the present disclosure.

FIG. 2 is a perspective view of a first sub-assembly 202, such as the sub-assembly 102, with a wet mate carrier 104 and a second sub-assembly 204 that can receive the first sub-assembly 202 in a wellbore 106 according to one example of the present disclosure. As illustrated in FIG. 2, the first sub-assembly 202 is positioned near the second sub-assembly 204 but not coupled with the second sub-assembly 204. The first sub-assembly 202 can include the wet mate carrier 104, a first wet mate connector 206*a*, a connection spring 208, a deflection actuator 210, and a guiding profile 212. In some examples, the first sub-assembly 202 can include any additional or alternative features to facilitate coupling the first sub-assembly 202 with the second sub-assembly 204.

In some examples, the first sub-assembly 202 can be or include a production sub-assembly such as a stinger sub-assembly. The first sub-assembly 202 can be positioned on a first string 214*a*, which may be or include a production string or any other suitable string that can be positioned in the wellbore 106. The first string 214*a* can be positioned in the wellbore 106 to connect the first sub-assembly 202 with the second sub-assembly 204, for example to establish a continuous energy transfer line using a first energy transfer line 216*a* and a second energy transfer line 216*b*. The first energy transfer line 216*a* may be coupled with the first wet mate connector 206*a*, and the second energy transfer line 216*b* may be coupled with a second wet mate connector 206*b* that may be positioned on the second sub-assembly 204. The second sub-assembly 204 may be or include a production sub-assembly that can be positioned on a second string 214*b*, which may be or include a production string or any other suitable string that can be positioned in the wellbore 106. The first sub-assembly 202 can be positioned in the wellbore 106 and can pass through an obstruction 116 that is in the wellbore 106. In response to the first sub-assembly 202 passing the obstruction 116, the wet mate carrier 104 can be actuated radially outward to at least approximately align the first wet mate connector 206*a* with the second wet mate connector 206*b*.

Figure 3:
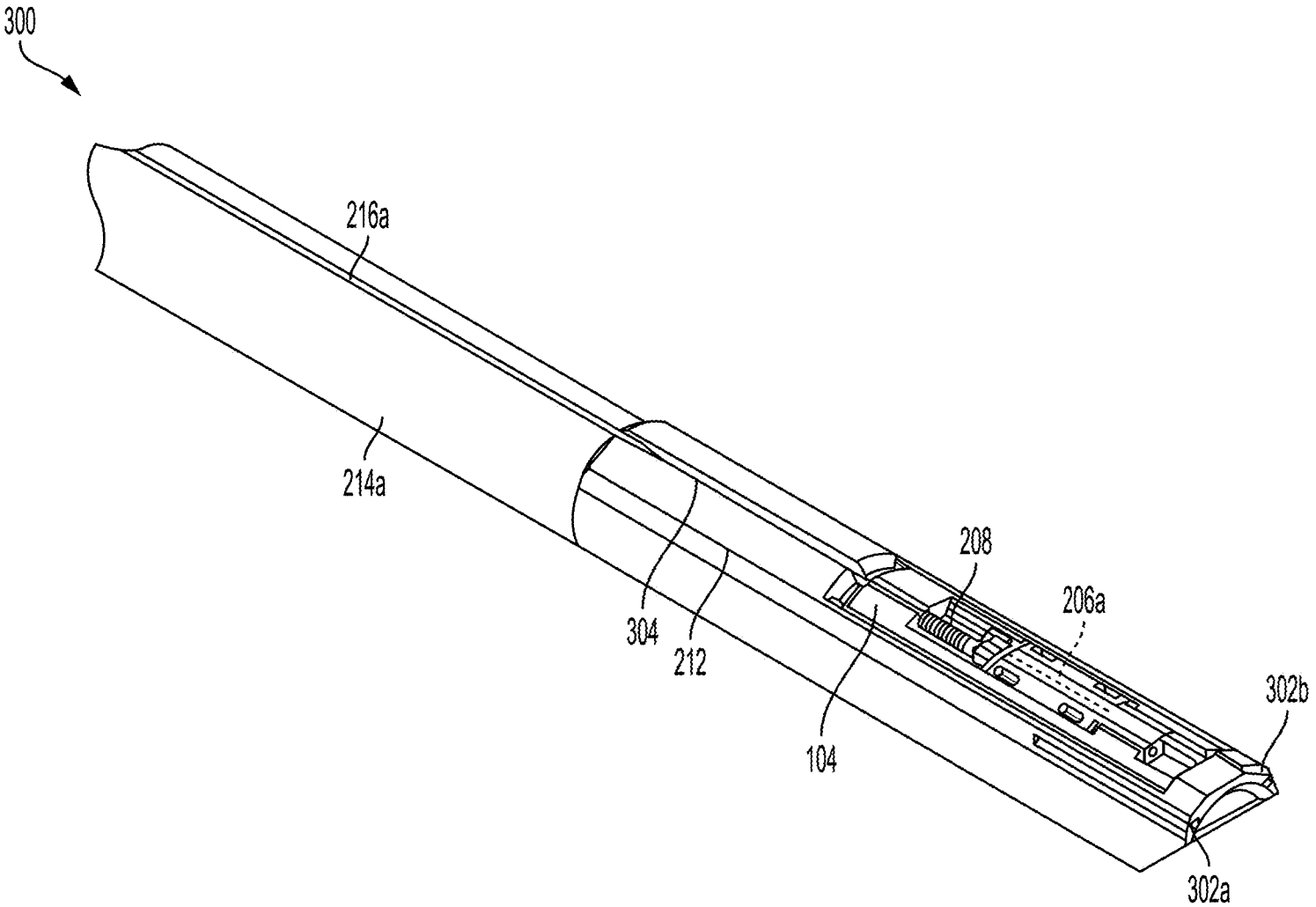
FIG. 3 is a perspective view of a sub-assembly that can include a wet mate carrier according to one example of the present disclosure.

FIG. 3 is a perspective view of a sub-assembly 300, such as the first sub-assembly 202, that can include a wet mate carrier 104 according to one example of the present disclosure. In some examples, the sub-assembly 300 may be or include a stinger sub-assembly that can be positioned in a wellbore 106 to be coupled with a completion sub-assembly such as the second sub-assembly 204. The sub-assembly 300 can include a wet mate carrier 104, a first wet mate connector 206*a*, a connection spring 208, a first deflection actuator 302*a*, a second deflection actuator 302*b*, a guiding profile 212, a first energy transfer line 216*a*, and an energy transfer line channel 304. The sub-assembly 300 may include any additional or alternative components for providing structure or functionality for the sub-assembly 300. Additionally or alternatively, the sub-assembly 300 may be positioned on or otherwise coupled with a first string 214*a*, which may be or include a production string or any other type of string that can be positioned in the wellbore 106.

The wet mate carrier 104 can be positioned on an outer surface, or an external surface, of the sub-assembly 300. In some examples, the outer surface may be or include an outer radius of at least a portion of the sub-assembly 300. The wet mate carrier 104 may include the first wet mate connector 206*a*, the connection spring 208, and any other suitable component from the sub-assembly 300. Additionally or alternatively, the wet mate carrier 104 may be at least mechanically coupled with the first deflection actuator 302*a*, the second deflection actuator 302*b*, or a combination thereof. For example, if the first deflection actuator 302*a*, the second deflection actuator 302*b*, or a combination thereof actuates or displaces from an initial position, then the wet mate carrier 104 may additionally actuate or displace.

As illustrated, the first wet mate connector 206*a* may be or include a female wet mate connector, though in other examples, the first wet mate connector 206*a* may be or include a male wet mate connector. The first wet mate connector 206*a* may be coupled with the first energy transfer line 216*a*. For example, coupling the first wet mate connector 206*a* with a separate wet mate connector, such as the second wet mate connector 206*b*, may cause the first energy transfer line 216*a* to couple with a separate energy transfer line, such as the second energy transfer line 216*b*, to form a continuous energy transfer line. In some examples, the first wet mate connector 206*a* may be coupled with the connection spring 208, which can facilitate connection between the first wet mate connector 206*a* and a separate wet mate connector such as the second wet mate connector 206*b*. The connection spring 208 may apply a spring force on the first wet mate connector 206*a* to allow the first wet mate connector 206*a* to be coupled with the separate wet mate connector even in instances in which the first wet mate connector 206*a* and the separate wet mate connector are not perfectly aligned.

The first deflection actuator 302*a* and the second deflection actuator 302*b* may be positioned in the sub-assembly 300. For example, the first deflection actuator 302*a*, the second deflection actuator 302*b*, or a combination thereof may be positioned on a shoulder or other external surface of the sub-assembly 300. The first deflection actuator 302*a* and the second deflection actuator 302*b* may extend from a first point on a front end of the sub-assembly 300 to a second point offset from the first point along a central axis of the sub-assembly 300. The first deflection actuator 302*a*, the second deflection actuator 302*b*, or a combination thereof may be at least mechanically coupled with the wet mate carrier 104. In some examples, and in response to the first deflection actuator 302*a*, the second deflection actuator 302*b*, or a combination thereof being actuated, the wet mate carrier 104 may be deflected or otherwise deployed radially outward with respect to the sub-assembly 300.

The guiding profile 212 may be positioned on a shoulder or other suitable external surface of the sub-assembly 300. The guiding profile 212 may be sized, shaped, or otherwise oriented to guide or align the sub-assembly 300 to properly coupled with a separate sub-assembly. For example, the guiding profile 212 may include one or more grooves, channels, flanges, and the like to cause the sub-assembly 300 to be in rotational and translational alignment with the separate sub-assembly. Additionally or alternatively, the sub-assembly 300 can include the energy transfer line channel 304, which may protect the first energy transfer line 216*a* from damage while running the sub-assembly 300 in a wellbore and past potential obstructions.

Figure 4:
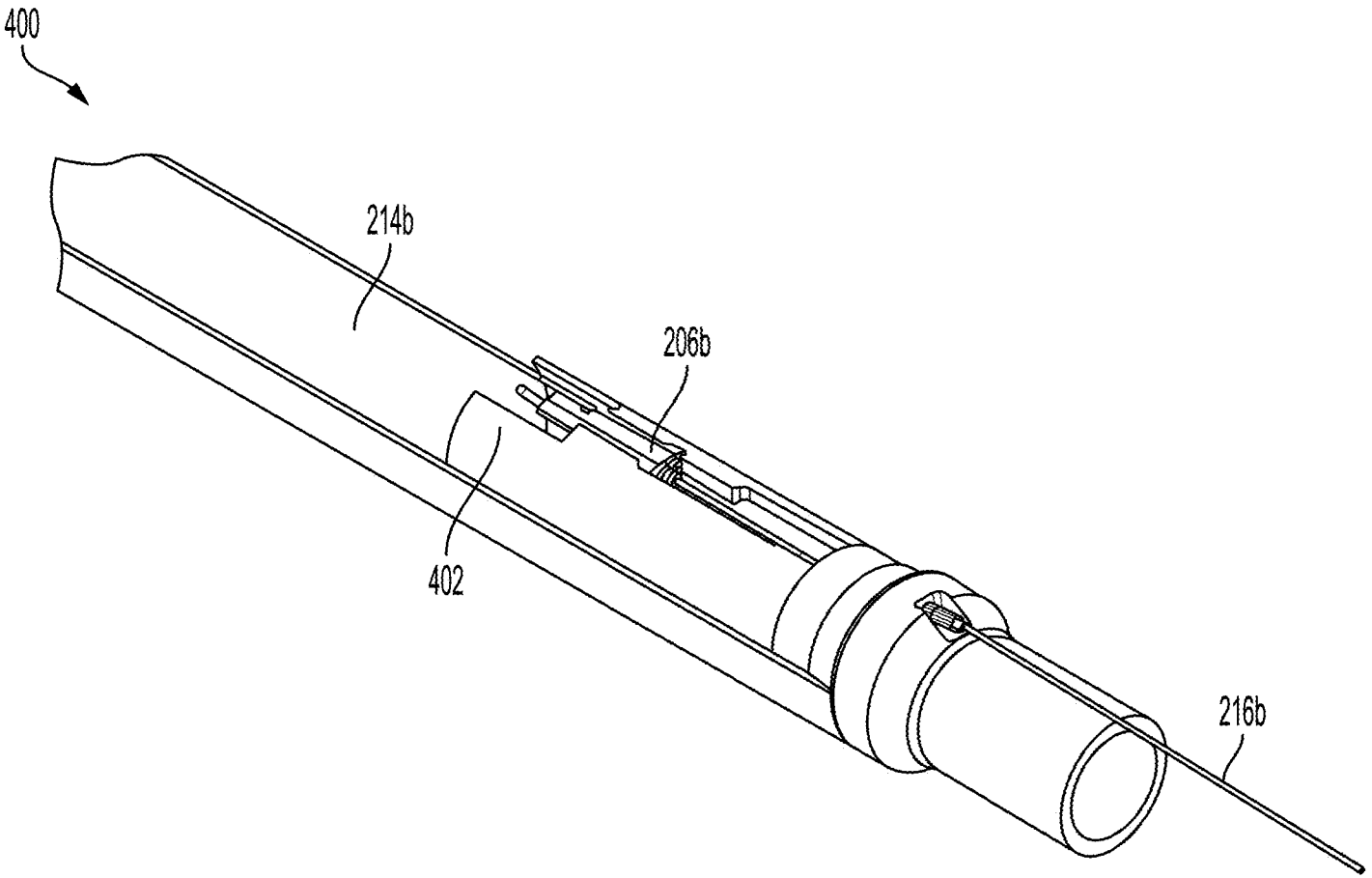
FIG. 4 is a perspective view of a sub-assembly that can receive a wet mate via a wet mate connector according to one example of the present disclosure.

FIG. 4 is a perspective view of a sub-assembly 400 that can receive a wet mate connector, such as the first wet mate connector 206*a*, via a second wet mate connector 206*b* according to one example of the present disclosure. As illustrated in FIG. 4, the sub-assembly 400 is a bottom sub-assembly, or a completion sub-assembly, though other suitable examples of sub-assemblies are possible for the sub-assembly 400. The sub-assembly 400 may be positioned downhole in a wellbore via a second string 214*b*, such as a completion string or any other suitable type of string that can be positioned in the wellbore. The second string 214*b* can be installed, for example permanently or semi-permanently, in the wellbore prior to completion operations, stimulation operations, production operations, and the like being performed with respect to the wellbore.

The second wet mate connector 206*b* can be positioned on an external surface or other suitable outer surface of the sub-assembly 400. In some embodiments, the second wet mate connector 206*b* may be positioned in an alignment cutout 402 of the sub-assembly 400. The alignment cutout 402 may be sized, shaped, or otherwise oriented to facilitate alignment of the sub-assembly 400 with a separate sub-assembly such as the sub-assembly 300. Additionally or alternatively, the alignment cutout 402 may be sized, shaped, or otherwise oriented to facilitate alignment of and coupling between the second wet mate connector 206*b* and a separate wet mate connector. The second wet mate connector 206*b* may be coupled with a second energy transfer line 216*b*, which may include a fiber optic line, an electrical line, a hydraulic line, or other suitable type of energy transfer line. In response to the second wet mate connector 206*b* being coupled with the separate wet mate connector, the second energy transfer line 216*b* may be coupled with a separate energy transfer line, such as the first energy transfer line 216*a*, to form a continuous path for energy transfer.

Figure 5:
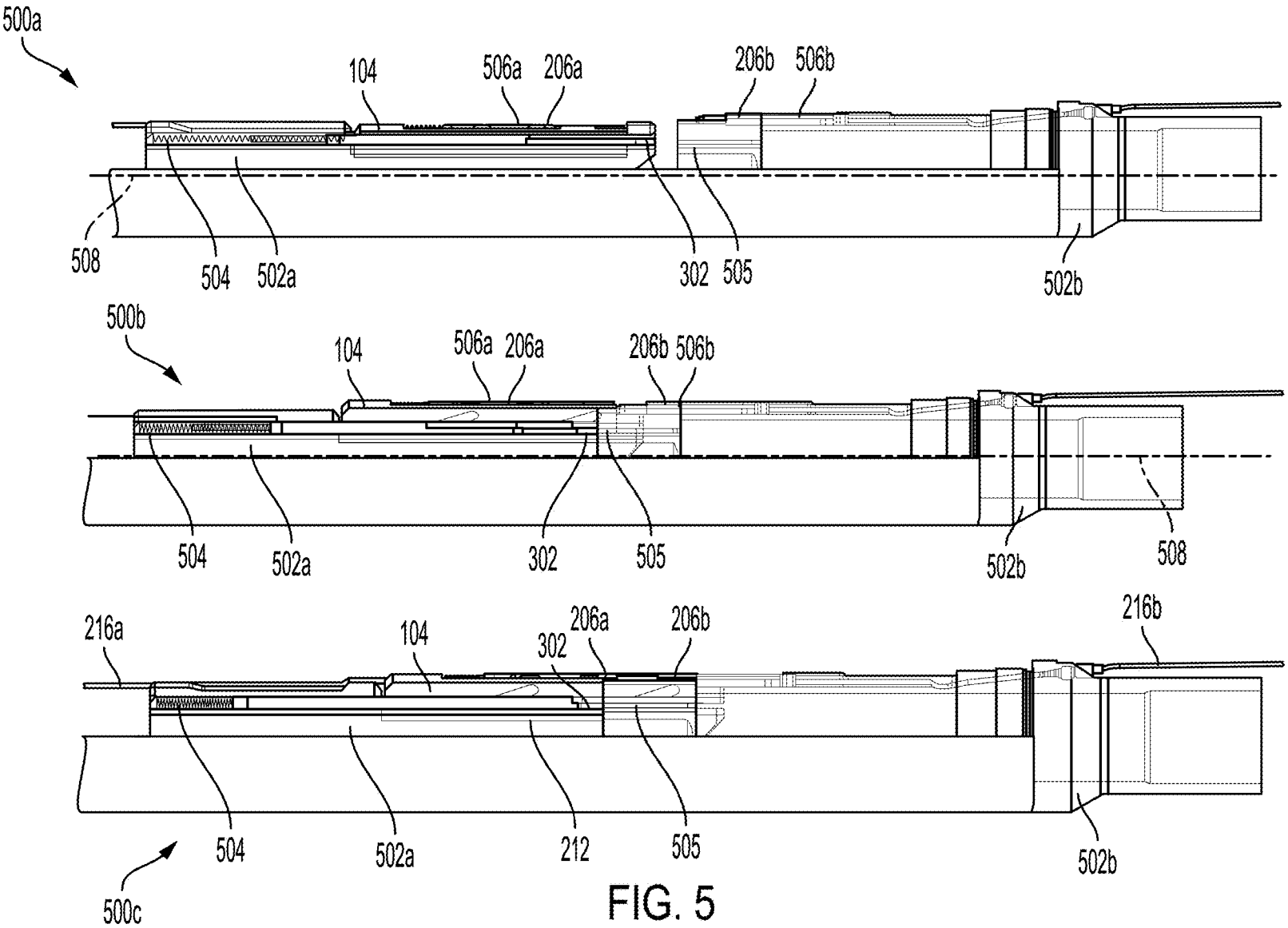
FIG. 5 is a set of side views of a first sub-assembly with a wet mate carrier and a second sub-assembly that can receive the first sub-assembly according to one example of the present disclosure.

FIG. 5 is a set of side views 500*a-c* of a first sub-assembly 502*a* with a wet mate carrier 104 and a second sub-assembly 502*b* that can receive the first sub-assembly 502*a* according to one example of the present disclosure. A first side view 500*a* illustrates the first sub-assembly 502*a* and the second sub-assembly 502*b* prior to being connected, the second side view 500*b* illustrates the first sub-assembly 502*a* and the second sub-assembly 502*b* while being connected, and the third side view 500*c* illustrates the first sub-assembly 502*a* and the second sub-assembly 502*b* after being connected, though any other suitable view of the first sub-assembly 502*a* and the second sub-assembly 502*b* are possible.

As illustrated in the first side view 500*a*, the first sub-assembly 502*a* can include the wet mate carrier 104, the first wet mate connector 206*a*, a deflection actuator 302, and a retraction spring 504, though the first sub-assembly 502*a* can include any additional or alternative components. Additionally or alternatively, the second sub-assembly 502*b* may include the second wet mate connector 206*b* and a deflection profile 505, though the second sub-assembly 502*b* may include any additional or alternative components. The first wet mate connector 206*a* may be positioned on the wet mate carrier 104, and the wet mate carrier 104 may be at least mechanically coupled with the deflection actuator 302. Additionally or alternatively, the deflection actuator 302 may be at least mechanically coupled with the retraction spring 504. As illustrated in the first side view 500*a*, the first wet mate connector 206*a* may be positioned at a first radius 506*a* with respect to a central axis 508, and the second wet mate connector 206*b* may be positioned at a second radius 506*b* with respect to the central axis 508. The first radius 506*a* may be smaller than the second radius 506*b*, for example prior to the first sub-assembly 502*a* mechanically engaging with the second sub-assembly 502*b*.

As illustrated in the second side view 500*b*, the first sub-assembly 502*a* may mechanically engage with the second sub-assembly 502*b* for example when the first sub-assembly 502*a* is positioned adjacent to or abutting the second sub-assembly 502*b*. The deflection actuator 302 of the first sub-assembly 502*a* may contact the deflection profile 505 of the second sub-assembly 504*b*, and positioning the first sub-assembly 502*a* further downhole, further into the second sub-assembly 502*b*, or the like may cause the deflection actuator 302 to be displaced by the deflection profile 505. The deflection profile 505 may be located on an inner surface of the second sub-assembly 502*b*. For example, the inner surface may include an inner radius defined by the second sub-assembly 502*b*. The inner radius may be an inner radius of a channel defined by the second sub-assembly 502*b* that can be sized to receive the first sub-assembly 502*a*. Displacing the deflection actuator 302 may cause the wet mate carrier 104 to deflect or otherwise deploy radially outward with respect to the central axis 508. For example, in response to the deflection actuator 302 being displaced by the deflection profile 505, the wet mate carrier 104 may displace radially outward to cause the first radius 506*a* of the first wet mate connector 206*a* to be approximately the same as the second radius 506*b* of the second wet mate connector 206*b*. The deflection actuator 302 may be displaced by the deflection profile 505 and may compress the retraction spring 504, which can apply a spring force on the deflection actuator 302 to allow the first sub-assembly 502*a* to be retracted from the second sub-assembly 502*b* and from a wellbore in which the first sub-assembly 502*a* is disposed.

As illustrated in the third side view 500*c*, the first sub-assembly 502*a* can be positioned in the second sub-assembly 502*b* to cause the first wet mate connector 206*a* to couple with the second wet mate connector 206*b*. Coupling the first wet mate connector 206*a* and the second wet mate connector 206*b* may cause the first energy transfer line 216*a* to couple with the second energy transfer line 216*b* to form a continuous path for energy transfer across the first sub-assembly 502*a* and the second sub-assembly 502*b*. The first sub-assembly 502*a* may be at least partially positioned in an interior volume of the second sub-assembly 502*b* and may be guided into the interior volume via the guiding profile 212. The guiding profile 212 may traverse a corresponding profile on an interior surface of the second sub-assembly 502*b* to align the first wet mate connector 206*a* with the second wet mate connector 206*b*.

In some examples, the first sub-assembly 502*a* may be removed from the wellbore or otherwise disconnected from the second sub-assembly 502*b*. For example, the first sub-assembly 502*a* may be removed from the wellbore to be positioned in a separate wellbore, to allow a subsequent operation to be performed, for maintenance, and the like. Additionally or alternatively, the first sub-assembly 502*a* may be disconnected from the second sub-assembly 502*b* to reorient the first sub-assembly 502*a* with respect to the second sub-assembly 502*b*, for example to improve or repair a connection between the first wet mate connector 206*a* and the second wet mate connector 206*b*. The first sub-assembly 502*a* can be moved out of the second sub-assembly 502*b*, and the retraction spring 504 can cause the deflection actuator 302 to return to a resting state, which may cause the wet mate carrier 104 to return to a retracted state, similar to a state illustrated by the first side view 500*a*.

Figure 6:
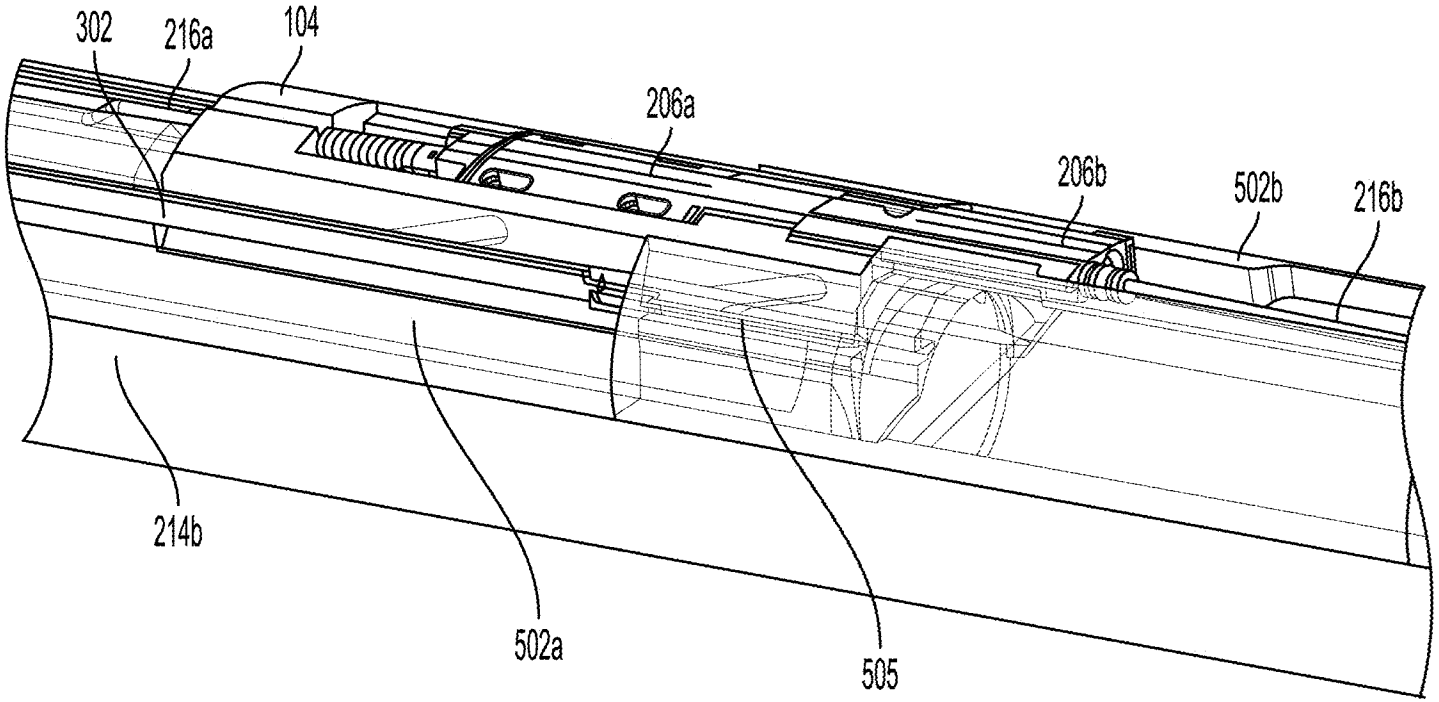
FIG. 6 is a perspective view of a first sub-assembly with a wet mate carrier coupled with a second sub-assembly according to one example of the present disclosure.

FIG. 6 is a perspective view of a first sub-assembly 502*a* with a wet mate carrier 104 coupled with a second sub-assembly 502*b* according to one example of the present disclosure. As illustrated in FIG. 6, the first sub-assembly 502*a* can be positioned at least partially in an interior volume defined by the second sub-assembly 502*b*, which may be installed or otherwise positioned on a second string 214*b* such as a completion string. The first wet mate connector 206*a*, which may be positioned on the wet mate carrier 104, may be coupled with the second wet mate connector 206*b*. The wet mate carrier 104 may be in a deflected state or an actuated state in which the wet mate carrier 104 has been deployed radially outward with respect to the first sub-assembly 502*a* to at least approximately align the first wet mate connector 206*a* with the second wet mate connector 206*b*. The deflection actuator 302 of the first sub-assembly 502*a* may contact the deflection profile 505 of the second sub-assembly 502*b* and may be displaced to cause the wet mate carrier 104 to deflect radially outward. The first wet mate connector 206*a* may couple with the second wet mate connector 206*b* to cause the first energy transfer line 216*a* to couple with the second energy transfer line 216*b* to form a continuous energy transfer path across the first sub-assembly 502*a* and the second sub-assembly 502*b*.

Figure 7:
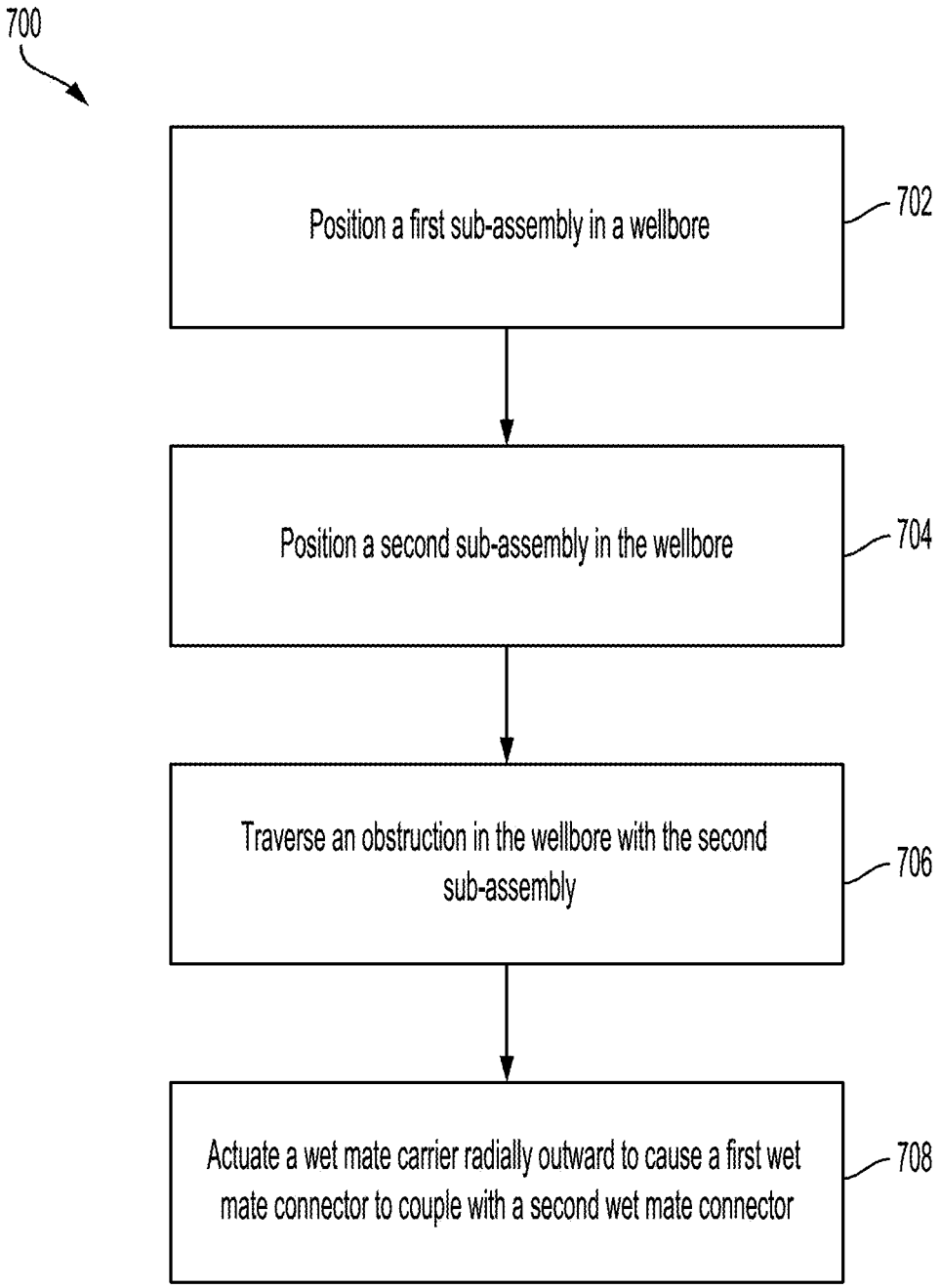
FIG. 7 is a flowchart of a process to use a wet mate carrier in a wellbore according to one example of the present disclosure.

FIG. 7 is a flowchart of a process 700 to use a wet mate carrier 104 in a wellbore according to one example of the present disclosure. At block 702, a first sub-assembly is positioned in a wellbore. The first sub-assembly may be similar or identical to the sub-assembly 400, the second sub-assembly 502*b*, or the like. Additionally or alternatively, the first sub-assembly may be or include a completion sub-assembly, which may be positioned or installed on a completion string that is positioned or installed in the wellbore. The first sub-assembly may include a first wet mate connector, such as a male wet mate connector, that may be coupled with a first energy transfer line, which may include a fiber optic line, an electrical line, a hydraulic line, or the like.

At block 704, a second sub-assembly can be positioned in the wellbore. The second sub-assembly may be similar or identical to the sub-assembly 300, the first sub-assembly 502*a*, or the like. Additionally or alternatively, the second sub-assembly may be or include a production sub-assembly, which may be positioned or installed on a production string that can be positioned or installed in the wellbore. The second sub-assembly may include a second wet mate connector, such as a female wet mate connector, that may be coupled with a second energy transfer line, which may include a fiber optic line, an electrical line, a hydraulic line, or the like. In some examples, a type of the second energy transfer line may be similar or identical to a type of the first energy transfer line. The second sub-assembly may be positioned in the wellbore during or after an obstruction is formed or identified in the wellbore. In a particular example, a gravel pack operation may be performed in the wellbore, and the second sub-assembly may be positioned in the wellbore after the gravel pack operation is performed, which may generate an obstruction in the wellbore. The obstruction may limit the maximum diameter of tools or production fluid that can flow through the wellbore.

At block 706, the second sub-assembly traverses the obstruction. The outer diameter of the second sub-assembly may be approximately the same as or less than an inner diameter defined by the obstruction. The second sub-assembly can be positioned in the wellbore and can pass through or by the obstruction without damaging the second sub-assembly, without damaging the wellbore, or a combination thereof. The second sub-assembly may include a wet mate carrier that may include the second wet mate connector. While traversing the obstruction, the wet mate carrier may be in a retracted state and may be flush with an outer diameter of the second sub-assembly or may otherwise not extend radially external with respect to the second sub-assembly.

At block 708, the wet mate carrier is actuated radially outward. The second sub-assembly may at least mechanically engage with the first sub-assembly to cause the wet mate carrier to actuate radially outward. For example, a deflection actuator of the second sub-assembly may mechanically engage with a deflection profile of the first sub-assembly. The deflection profile may be or include a flange that extends from an interior surface of the first sub-assembly and may cause the deflection actuator to displace from a resting state. The wet mate carrier may be at least mechanically coupled with the deflection actuator, and displacing the deflection actuator may cause the wet mate carrier to actuate radially outward to cause the first wet mate connector to at least approximately align with the second wet mate connector. The first sub-assembly can be positioned in the second sub-assembly to cause the first wet mate connector to couple with the second wet mate connector.

In some aspects, systems and sub-assemblies for a wet mate carrier for radial deployment of a downhole wet mate connector are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a first sub-assembly comprising a first wet mate connector and a deflection profile; and a second sub-assembly comprising (i) a wet mate carrier comprising a second wet mate connector and located on an outer surface of the second sub-assembly and (ii) a deflection actuator, the deflection actuator displaceable by the deflection profile to cause the wet mate carrier to deflect outward to cause the second wet mate connector to couple with the first wet mate connector.

Example 2 is the system of example 1, wherein the deflection profile is located on a first surface of the first sub-assembly, and wherein the second sub-assembly is positionable in the first surface of the first sub-assembly such that the deflection actuator is in contact with the deflection profile.

Example 3 is the system of any of examples 1-2, wherein the second sub-assembly comprises a first guiding profile located on a second surface of the second sub-assembly, wherein the first sub-assembly comprises a second guiding profile located on the first surface of the first sub-assembly, and wherein the second sub-assembly is positionable in the first surface of the first sub-assembly such that the second guiding profile is traversable by the first guiding profile to cause the second wet mate connector to align with the first wet mate connector.

Example 4 is the system of example 1, wherein the wet mate carrier is arrangeable in a retracted state to cause the second wet mate connector to be located at a first radius with respect to a central axis shared by the first sub-assembly and the second sub-assembly, and wherein the first radius is smaller than a second radius, with respect to the central axis, at which the first wet mate connector is located.

Example 5 is the system of any of examples 1 and 4, wherein the deflection actuator is actuatable by the deflection profile to cause the wet mate carrier to transform into an actuated state in which the second wet mate connector is located approximately at the second radius.

Example 6 is the system of example 1, wherein the first wet mate connector is coupled with a first energy transfer line, wherein the second wet mate connector is coupled with a second energy transfer line, and wherein the first energy transfer line and the second energy transfer line are the same type of energy transfer line.

Example 7 is the system of example 1, wherein the second sub-assembly further comprises a retraction spring located abutting the deflection actuator, wherein force is appliable by the retraction spring on the deflection actuator to cause the wet mate carrier to transform from an actuated state to a retracted state.

Example 8 is a sub-assembly comprising: a wet mate carrier comprising a first wet mate connector and located on an outer surface of the sub-assembly; and a deflection actuator coupled with the wet mate carrier, the deflection actuator displaceable by a deflection profile of a separate sub-assembly to cause the wet mate carrier to deflect outward to cause the first wet mate connector to couple with a second wet mate connector of the separate sub-assembly.

Example 9 is the sub-assembly of example 8, wherein the deflection profile is located on a first surface of the separate sub-assembly, and wherein the sub-assembly is positionable in the first surface of the separate sub-assembly such that the deflection actuator is located abutting the deflection profile.

Example 10 is the sub-assembly of any of examples 8-9, further comprising a first guiding profile located on a second surface of the sub-assembly, wherein the separate sub-assembly comprises a second guiding profile located on the first surface of the separate sub-assembly, and wherein the sub-assembly is positionable in the first surface of the separate sub-assembly such that the second guiding profile is traversable by the first guiding profile to cause the first wet mate connector to align with the second wet mate connector.

Example 11 is the sub-assembly of example 8, wherein the wet mate carrier is arrangeable a retracted state to cause the first wet mate connector to be located at a first radius with respect to a central axis shared by the sub-assembly and the separate sub-assembly, and wherein the first radius is smaller than a second radius, with respect to the central axis, at which the second wet mate connector is located.

Example 12 is the sub-assembly of any of examples 8 and 11, wherein the deflection actuator is actuatable by the deflection profile to cause the wet mate carrier to transform into an actuated state in which the first wet mate connector is located approximately at the second radius.

Example 13 is the sub-assembly of example 8, wherein the first wet mate connector is coupled with an energy transfer line that comprises a fiber optic transfer line, an electric transfer line, or a hydraulic transfer line.

Example 14 is the sub-assembly of example 8, further comprising a retraction spring located abutting the deflection actuator, wherein force is appliable by the retraction spring on the deflection actuator to cause the wet mate carrier to transform from an actuated state to a retracted state.

Example 15 is a system comprising: a first sub-assembly comprising (i) a first wet mate connector coupled with a first energy transfer line and (ii) a deflection profile located on a first surface of the first sub-assembly; and a second sub-assembly comprising (i) a wet mate carrier comprising a second wet mate connector coupled with a second energy transfer line, the wet mate carrier located on an outer surface of the second sub-assembly and (ii) a deflection actuator coupled with the wet mate carrier, the deflection actuator displaceable by the deflection profile to cause the wet mate carrier to deflect outward to cause the second wet mate connector to couple with the first wet mate connector.

Example 16 is the system of example 15, wherein the second sub-assembly is positionable in the first surface of the first sub-assembly such that the deflection actuator is located abutting the deflection profile.

Example 17 is the system of any of examples 15-16, wherein the second sub-assembly comprises a first guiding profile located on an second surface of the second sub-assembly, wherein the first sub-assembly comprises a second guiding profile located on the first surface of the first sub-assembly, and wherein the second sub-assembly is positionable in the first surface of the first sub-assembly such that the second guiding profile is traversable by the first guiding profile to cause the second wet mate connector to align with the first wet mate connector.

Example 18 is the system of example 15, wherein the wet mate carrier is arrangeable in a retracted state to cause the second wet mate connector to be located at a first radius with respect to a central axis shared by the first sub-assembly and the second sub-assembly, and wherein the first radius is smaller than a second radius, with respect to the central axis, at which the first wet mate connector is located.

Example 19 is the system of any of examples 15 and 18, wherein the deflection actuator is actuatable by the deflection profile to cause the wet mate carrier to transform into an actuated state in which the second wet mate connector is located approximately at the second radius.

Example 20 is the system of example 15, wherein the second sub-assembly further comprises a retraction spring located abutting the deflection actuator, wherein force is appliable by the retraction spring on the deflection actuator to cause the wet mate carrier to transform from an actuated state to a retracted state.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a first sub-assembly comprising a first wet mate connector, a deflection profile, and a first surface; and a second sub-assembly comprising (i) a wet mate carrier comprising a second wet mate connector and located on an outer surface of the second sub-assembly, (ii) a deflection actuator, the deflection actuator displaceable by the deflection profile to cause the wet mate carrier to deflect outward to cause the second wet mate connector to couple with the first wet mate connector, and (iii) a first guiding profile located on a second surface of the second sub-assembly, the second sub-assembly being positionable in the first surface of the first sub-assembly such that a second guiding profile of the first sub-assembly is traversable by the first guiding profile to cause the second wet mate connector to align with the first wet mate connector.

2. The system of claim 1, wherein the second sub-assembly is positionable in the first surface of the first sub-assembly such that the deflection actuator is in contact with the deflection profile.

3. The system of claim 2, wherein the first sub-assembly comprises the second guiding profile located on the first surface of the first sub-assembly.

4. The system of claim 1, wherein the wet mate carrier is arrangeable in a retracted state to cause the second wet mate connector to be located at a first radius with respect to a central axis shared by the first sub-assembly and the second sub-assembly, and wherein the first radius is smaller than a second radius, with respect to the central axis, at which the first wet mate connector is located.

5. The system of claim 4, wherein the deflection actuator is actuatable by the deflection profile to cause the wet mate carrier to transform into an actuated state in which the second wet mate connector is located approximately at the second radius.

6. The system of claim 1, wherein the first wet mate connector is coupled with a first energy transfer line, wherein the second wet mate connector is coupled with a second energy transfer line, and wherein the first energy transfer line and the second energy transfer line are the same type of energy transfer line.

7. The system of claim 1, wherein the second sub-assembly further comprises a retraction spring located abutting the deflection actuator, wherein force is appliable by the retraction spring on the deflection actuator to cause the wet mate carrier to transform from an actuated state to a retracted state.

8. A sub-assembly comprising:

a wet mate carrier comprising a first wet mate connector and located on an outer surface of the sub-assembly; and a deflection actuator coupled with the wet mate carrier, the deflection actuator displaceable by a deflection profile of a separate sub-assembly to cause the wet mate carrier to deflect outward to cause the first wet mate connector to couple with a second wet mate connector of the separate sub-assembly, wherein the deflection profile is located on a first surface of the separate sub-assembly, and wherein the sub-assembly is positionable in the first surface of the separate sub-assembly such that a second guiding profile is traversable by a first guiding profile of the sub-assembly to cause the first wet mate connector to align with the second wet mate connector.

9. The sub-assembly of claim 8, wherein the sub-assembly is positionable in the first surface of the separate sub-assembly such that the deflection actuator is located abutting the deflection profile.

10. The sub-assembly of claim 9, wherein the separate sub-assembly comprises the second guiding profile located on the first surface of the separate sub-assembly.

11. The sub-assembly of claim 8, wherein the wet mate carrier is arrangeable in a retracted state to cause the first wet mate connector to be located at a first radius with respect to a central axis shared by the sub-assembly and the separate sub-assembly, and wherein the first radius is smaller than a second radius, with respect to the central axis, at which the second wet mate connector is located.

12. The sub-assembly of claim 11, wherein the deflection actuator is actuatable by the deflection profile to cause the wet mate carrier to transform into an actuated state in which the first wet mate connector is located approximately at the second radius.

13. The sub-assembly of claim 8, wherein the first wet mate connector is coupled with an energy transfer line that comprises a fiber optic transfer line, an electric transfer line, or a hydraulic transfer line.

14. The sub-assembly of claim 8, further comprising a retraction spring located abutting the deflection actuator, wherein force is appliable by the retraction spring on the deflection actuator to cause the wet mate carrier to transform from an actuated state to a retracted state.

15. A system comprising:

a first sub-assembly comprising (i) a first wet mate connector coupled with a first energy transfer line and (ii) a deflection profile located on a first surface of the first sub-assembly; and a second sub-assembly comprising (i) a wet mate carrier comprising a second wet mate connector coupled with a second energy transfer line, the wet mate carrier located on an outer surface of the second sub-assembly and (ii) a deflection actuator coupled with the wet mate carrier, the deflection actuator displaceable by the deflection profile to cause the wet mate carrier to deflect outward to cause the second wet mate connector to couple with the first wet mate connector, wherein the second sub-assembly comprises a first guiding profile located on a second surface of the second sub-assembly, and wherein the second sub-assembly is positionable in the first surface of the first sub-assembly such that a second guiding profile is traversable by the first guiding profile to cause the second wet mate connector to align with the first wet mate connector.

16. The system of claim 15, wherein the second sub-assembly is positionable in the first surface of the first sub-assembly such that the deflection actuator is located abutting the deflection profile.

17. The system of claim 16, wherein the first sub-assembly comprises the second guiding profile located on the first surface of the first sub-assembly.

18. The system of claim 15, wherein the wet mate carrier is arrangeable in a retracted state to cause the second wet mate connector to be located at a first radius with respect to a central axis shared by the first sub-assembly and the second sub-assembly, and wherein the first radius is smaller than a second radius, with respect to the central axis, at which the first wet mate connector is located.

19. The system of claim 18, wherein the deflection actuator is actuatable by the deflection profile to cause the wet mate carrier to transform into an actuated state in which the second wet mate connector is located approximately at the second radius.

20. The system of claim 15, wherein the second sub-assembly further comprises a retraction spring located abutting the deflection actuator, wherein force is appliable by the retraction spring on the deflection actuator to cause the wet mate carrier to transform from an actuated state to a retracted state.

* * * * *